US005486098A

United States Patent [19]

Kimura et al.

[11] Patent Number: 5,486,098

[45] Date of Patent: Jan. 23, 1996

[54] SWASH PLATE TYPE VARIABLE DISPLACEMENT COMPRESSOR

[75] Inventors: Kazuya Kimura; Masafumi Ito; Hideki Mizutani; Yoshihiro Makino; Suguru Hirota; Taro Ozeki; Keiichi Kato; Hiroaki Kayukawa, all of Kariya, Japan

[73] Assignee: Kabushiki Kaisha Toyoda Jidoshokki Seisakusho, Kariya, Japan

[21] Appl. No.: 173,506

[22] Filed: Dec. 23, 1993

[30] Foreign Application Priority Data

Dec. 28, 1992 [JP] Japan ..... 4-347843

[51] Int. Cl.[6] ..... F04B 1/12

[52] U.S. Cl. ..... 417/222.2; 417/269; 417/516

[58] Field of Search ..... 417/222.2, 222.1, 417/269, 270, 516

[56] References Cited

U.S. PATENT DOCUMENTS

| | | | |
|---|---|---|---|
| 3,817,660 | 6/1974 | Knowles et al. | 417/269 |
| 4,007,663 | 2/1977 | Nagatomo et al. | 417/269 |
| 4,174,191 | 11/1979 | Roberts | 417/269 |
| 5,044,892 | 9/1991 | Pettitt | 417/269 |
| 5,207,078 | 5/1993 | Kimura et al. | 417/269 |
| 5,232,349 | 8/1993 | Kimura et al. | 417/269 |
| 5,286,173 | 2/1994 | Takenaka et al. | 417/269 |
| 5,366,350 | 11/1994 | Fujii et al. | 417/269 |
| 5,368,449 | 11/1994 | Kimura et al. | 417/269 |
| 5,370,506 | 12/1994 | Fujii et al. | 417/269 |
| 5,372,483 | 12/1994 | Kimura et al. | 417/269 |
| 5,380,163 | 1/1995 | Fujii et al. | 417/269 |
| 5,380,165 | 1/1995 | Kimura et al. | 417/269 |
| 5,380,168 | 1/1995 | Kimura et al. | 417/269 |
| 5,385,450 | 1/1995 | Kimura et al. | 417/269 |

FOREIGN PATENT DOCUMENTS

| | | | |
|---|---|---|---|
| 0220798 | 5/1987 | European Pat. Off. | 417/222.2 |
| 350135 | 3/1922 | Germany . | |
| 4019027 | 6/1990 | Germany . | |
| 3711979 | 9/1990 | Germany . | |
| 4033422 | 10/1990 | Germany . | |
| 58-158382 | 9/1983 | Japan . | |
| 5231309 | 9/1993 | Japan | 417/269 |
| 6117365 | 7/1994 | Japan | 417/269 |

*Primary Examiner*—Richard A. Bertsch
*Assistant Examiner*—Peter G. Korytnyk
*Attorney, Agent, or Firm*—Brooks Haidt Haffner & Delahunty

[57] ABSTRACT

A swash plate type variable displacement compressor comprises cylinder bores, pistons, a suction chamber and a discharge chamber. A suction valve introduces a low pressure gas into a working chamber in each cylinder bore. A discharge valve introduces a high pressure gas in the working chamber into the discharge chamber during a compression stroke. A crank chamber communicates to each of the cylinder bores at rear sides of the pistons. A swash plate is tiltably supported on a drive shaft and connected to each of the pistons through associated rods. The swash plate makes the pistons reciprocate in response to its undulating swing motion and varies its inclination angle based upon pressure differential between pressure in the suction chamber and pressure in the crank chamber therefore adjusting discharge displacement. A gas supply passage communicates each cylinder bore to the crank chamber in order to supply gas having a lower pressure than that in the working chamber at the time of completing the compression stroke. A gas bleed passage communicates the crank chamber to the suction chamber in order to introduce gas in the crank chamber into the suction chamber. A pressure control valve is provided in the gas supply passage or the gas bleed passage to control pressure of gas in the crank chamber. A valve is provided for opening and closing the gas supply passage in the middle of the compression stroke of each of the pistons.

12 Claims, 9 Drawing Sheets

SWASH PLATE TYPE VARIABLE DISPLACEMENT COMPRESSOR

BACKGROUND OF THE INVENTION

1. Field of the Invention

The present invention relates generally to a variable displacement type compressor that is employed to compress a refrigerant gas used in a vehicular air conditioning system. More specifically, the present invention relates to a swash plate type variable displacement compressor that can vary discharge displacement thereof by changing an inclination angle of a swash plate based upon the differential pressure between the suction chamber and the crank chamber.

2. Description of the Background Art

Conventionally, Japanese Unexamined Patent Publication No. 58-158382 discloses a swash plate type variable displacement compressor, which is a preferable compressor used in a vehicular air conditioning system. This compressor controls pressure in its crank chamber with respect to suction pressure in order to vary the discharge displacement of the compressor by varying an inclination angle of a swash plate in response to both suction and discharge pressures.

More specifically, according to this compressor, for example, when a cooling load decreases or a suction pressure decreases in response to a high speed rotation thereof, a bellows in a discharge displacement regulating mechanism is stretched because of the differential pressure balance between the suction pressure and atmospheric pressure. This stretch of the bellows causes a valve mechanism to be operated so as to decrease the capacity of a bleed passage between a suction chamber and a crank chamber. The gas passage disposed between the discharge chamber and the crank chamber is independently regulated by a separate valve mechanism. Therefore, the pressure in the crank chamber and the pressure acting on the rear surfaces of pistons is increased, causing the inclination angle of the swash plate to decrease. The stroke of each piston is thereby decreased, such that a preferable amount of refrigerant gas with respect to the suction pressure will be discharged.

However, according to the above-described conventional compressor, the highly pressurized refrigerant gas discharged from the discharge chamber after completing a compression stroke is used to increase the pressure in the crank chamber. When this refrigerant gas is supplied into the crank chamber through the gas passage or introduced into the suction chamber through the bleed passage, the pressure thereof is reduced. Therefore, there is a drawback that the power consumed to control the displacement is reduced by the amount relating to this reduced pressure.

SUMMARY OF THE INVENTION

Accordingly, it is a primary objective of the present invention to provide a swash plate type variable displacement compressor that can reduce the loss of power consumed to control the displacement thereof.

To achieve the foregoing and other objects in accordance with the purpose of the present invention, a swash plate type variable displacement compressor is provided with cylinder bores formed in a casing, pistons reciprocally housed in the cylinder bores, respectively, each of the pistons varying the volume of a working chamber in each of the cylinder bores according to selected reciprocation of each of the pistons. A suction chamber and a discharge chamber are provided in the casing. A suction valve is provided for introducing a low pressure gas into the working chamber by communicating the working chamber to the suction chamber during a suction stroke where each of the pistons so moves as to increase the volume of the working chamber. A discharge valve is provided for introducing a high pressure gas in the working chamber into the discharge chamber by communicating the working chamber to the discharge chamber during a compression stroke where each of the pistons so moves as to decrease the volume of the working chamber. A crank chamber communicates to each of the cylinder bores at rear sides of the pistons. A drive shaft is rotatably provided in the crank chamber. A swash plate is tiltably supported on the drive shaft and connected to each of the pistons through associated rods. The swash plate makes the pistons reciprocate in response to its swing motion and varies its inclination angle based upon pressure differential between pressure in the suction chamber and pressure in the crank chamber, so that the selected stroke of each of the pistons varies for adjusting discharge displacement in relation to the pressure in the suction chamber. A gas supply passage communicate each of the cylinder bores to the crank chamber in order to supply gas having a lower pressure than that in the working chamber at the time of completing the compression stroke. A gas bleed passage communicates the crank chamber to the suction chamber in order to introduce gas in the crank chamber into the suction chamber. A pressure control valve is provided in the gas supply passage or the gas bleed passage to control pressure of gas in the crank chamber by opening and closing the one passage. A valve is provided for opening and closing the gas supply passage in the middle of the compression stroke of each of the pistons.

BRIEF DESCRIPTION OF THE DRAWINGS

The features of the present invention that are believed to be novel are set forth with particularity in the appended claims. The invention, together with objects and advantages thereof, may best be understood by reference to the following description of the preferred embodiments together with the accompanying drawings, in which:

FIG. 1 is a longitudinal cross-sectional view of the swash plate type variable displacement compressor;

FIG. 2 is a transverse section of the compressor;

FIG. 3 is a perspective view of a rotary valve of the compressor in FIG. 1;

FIG. 4 is a development of a peripheral surface of the rotary valve in FIG. 3;

FIG. 5 is a schematic view showing the relationship between the working chamber, crank chamber and suction chamber of the compressor in FIG. 1;

FIG. 6 is an enlarged cross-sectional view of a pressure regulating valve employed in the compressor in FIG. 1;

FIG. 7 is a graph showing a relation between a position of piston and a pressure in the working chamber according to the compressor in FIG. 1;

FIG. 8 is a cycle diagram showing a relation between the displacement and the pressure in the working chamber according to the compressor in FIG. 1;

FIG. 9 is a longitudinal cross-sectional view of a swash plate type variable displacement compressor;

FIG. 10 is an enlarged cross-sectional view of the pressure regulating valve employed in the compressor in FIG. 9;

FIG. 11 is a perspective view of the rotary valve employed in the compressor in FIG. 9;

FIG. 12 is a development of the peripheral surface of the rotary valve in FIG. 11;

FIG. 13 is a schematic view showing the relationship between the working chamber, crank chamber and suction chamber in the compressor in FIG. 9;

DETAILED DESCRIPTION OF THE PREFERRED EMBODIMENTS

The first embodiment according to the present invention will now be described. The fundamental structure of a swash plate type displacement compressor according to the present invention is described in the first embodiment. The second embodiment will be described focusing on the differences from the first embodiment.

First Embodiment

Figure 1:
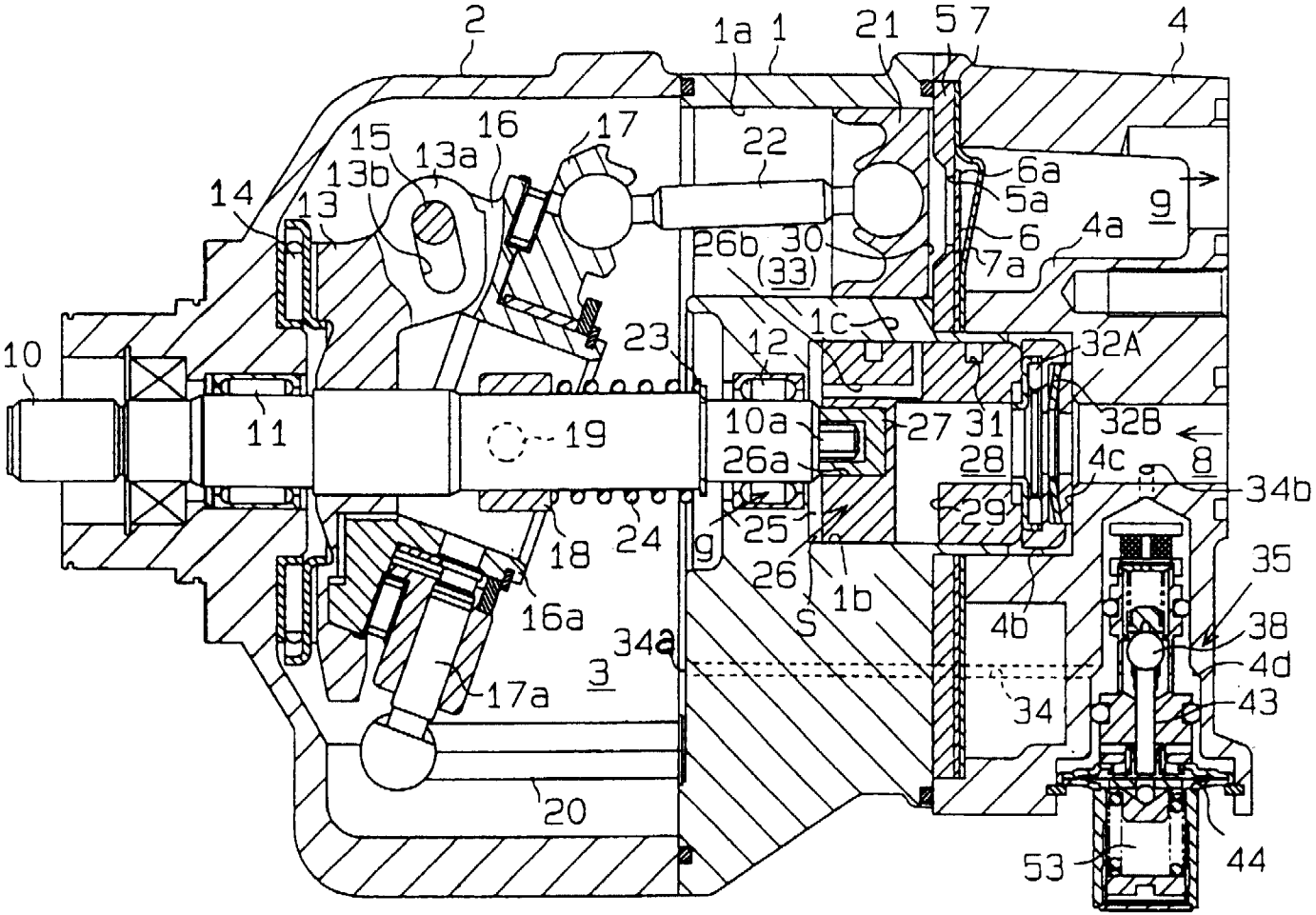
FIGS. 1 through 8 show a first embodiment of a swash plate type variable displacement compressor according to the present invention.

The first embodiment according to the present invention will now be described referring to FIGS. 1 through 8. As shown in FIG. 1, the casing of a swash plate type variable displacement compressor (hereinafter referred to as simply the compressor), includes a cylinder block 1, a front housing 2 secured to the front end of the cylinder block 1 (i.e., left side of FIG. 1), and a rear housing 4 secured to the rear end of the cylinder block 1. A drive shaft 10 is rotatably supported by means of a pair of radial bearings 11, 12 disposed in the cylinder block 1 and the front housing 2 respectively. The drive shaft 10 is rotated by means of an engine which may be mounted on a vehicle.

Figure 2:
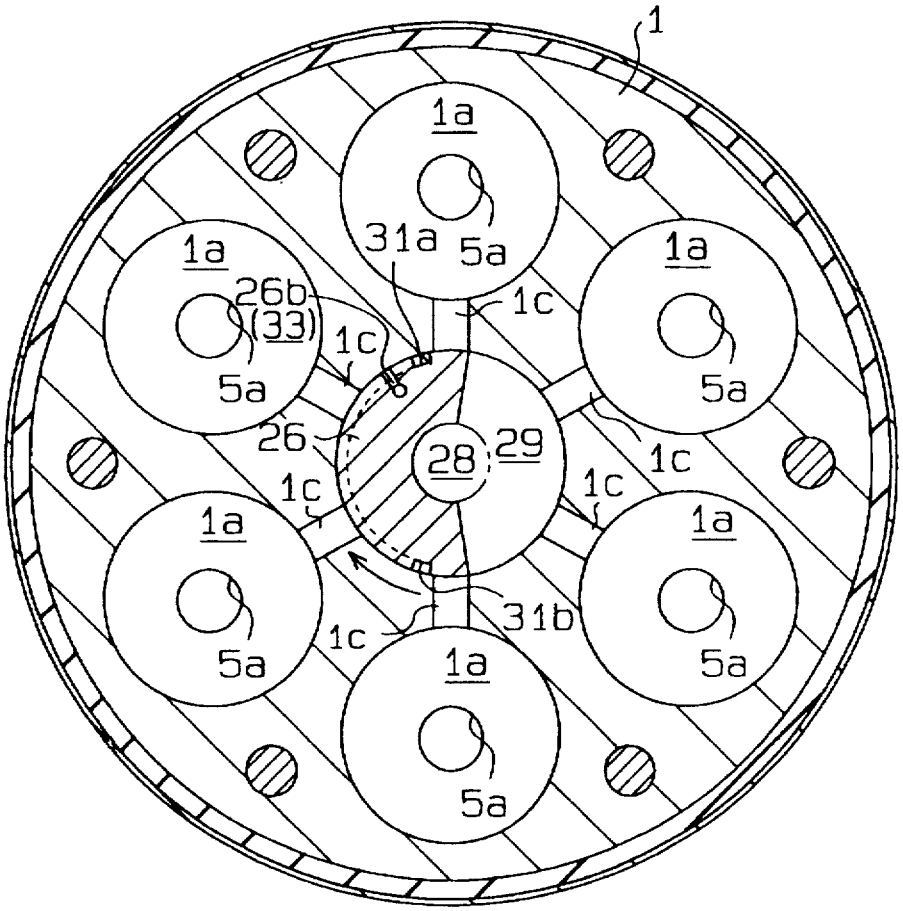
Figure 3:
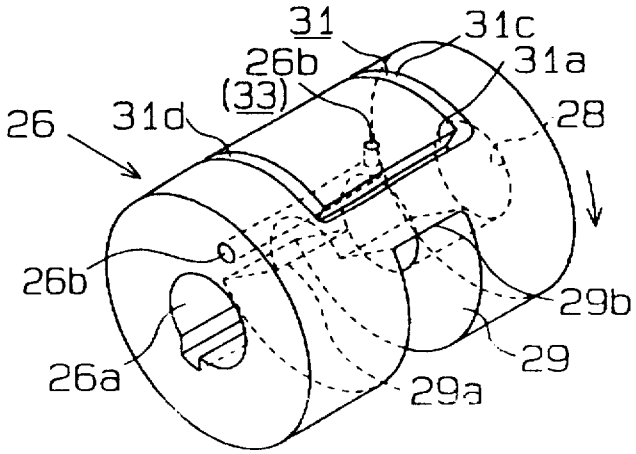
Figure 4:
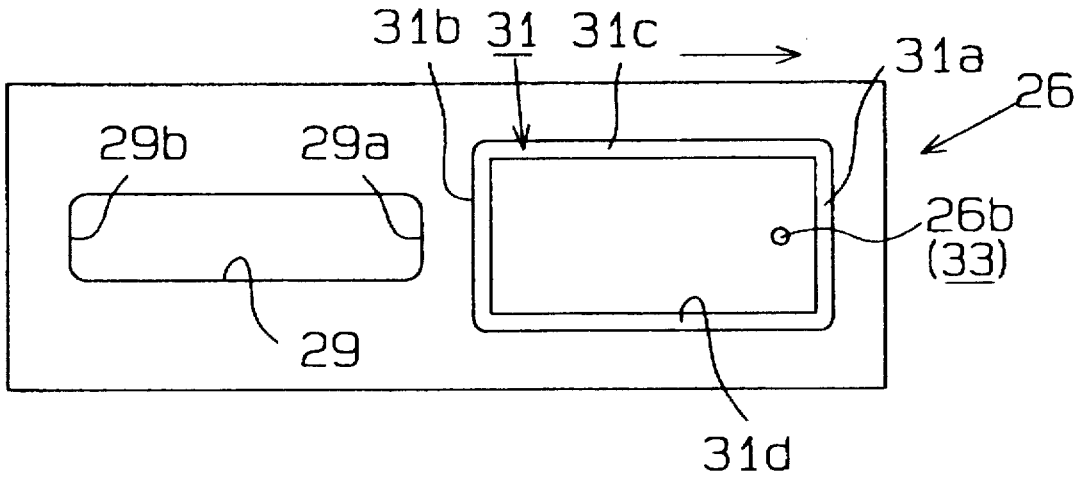

As shown in FIGS. 1 and 2, a plurality of cylinder bores 1*a* (i.e., six bores in this embodiment) are located equiangular around the drive shaft 10. Each bore 1*a* extends along the drive shaft 10 in parallel, and penetrates through the cylinder block 1. Each cylinder bore 1*a* accommodates a piston 21, which slidably reciprocates within the associated bore 1*a*.

As shown in FIG. 1, a valve plate 5, discharge plate 6 and a retainer plate 7 are layered one on another and disposed between the cylinder block 1 and the rear housing 4. A working chamber 30 is defined by the valve plate 5, the cylinder bore 1*a* and the piston 21. The volume of the working chamber 30 varies in response to the reciprocal movement of the corresponding piston 21. In other words, when the piston 21 moves rightward with respect to the FIG. 1, (i.e., in the compression stroke), the volume of the working chamber 30 decreases. When the piston 21 moves leftward (i.e., in the suction stroke), the volume of the working chamber 30 increases.

In the rear half of the rear housing 4, a suction chamber 8 is coaxially disposed with the drive shaft 10. The suction chamber 8 has an opening through the rear end surface of the rear housing 4. The suction chamber 8 communicates with each of the cylinder bores 1*a* through a valve chamber 25 and first passages 1*c*, one for each cylinder bore 1*a*. The valve chamber 25 is formed with a cylindrical recess 1*b* that is disposed in the rear half portion of the cylinder block 1 and a cylindrical recess 4*b* that is disposed in the front half portion of the rear housing 4. The front end of the suction chamber 8 opens to the recess 4*b*. The first passages 1*c* radially and angularly extend from the inner peripheral surface of the recess 1*b* toward the front side of the compressor, and open to the associated cylinder bores 1*a*, respectively. Therefore, the low pressurized refrigerant gas outside of the casing can be sucked into each working chamber 30 through the suction chamber 8, the valve chamber 25 and each first passage 1*c*.

A cylindrical shaped rotary valve 26 which functions as a suction valve is accommodated in the valve chamber 25, in order to allow and cut off the communication between the suction chamber 8 and each working chamber 30. A fitting hole 26*a* is provided in the front portion of the rotary valve 26. A projection 10*a* disposed at the end portion of the drive shaft 10 is fitted into the hole 26*a*, via a coupling 27. As the projection 10*a* engages with the hole 26*a*, the rotary valve 26 integrally rotates with the drive shaft 10 while slidably contacting with the inner peripheral surface of the valve chamber 25. A thrust bearing 32A and a belleville spring 32B are disposed between the rotary valve 26 and a bottom surface 4*c* of the recess 4*b*. Therefore, the rotary valve 26 smoothly rotates while the rearward movement thereof is regulated by the function of the bearing 32A and spring 32B.

As shown in FIGS. 1 through 4, the outer peripheral surface of the rotary valve 26 functions to cut off the communication between the suction chamber 8 and each working chamber 30. A suction passage 28 is formed in the rotary valve 26 and extends along the axial direction from the rear end surface of the valve 26 to the front side. A suction guiding groove 29 having a generally semicircle shape in cross-section is formed in the rotary valve 26, and extends radially outwardly from the front end of the suction passage 28, opening to the outer peripheral surface of the valve 26. The suction passage 28 and the groove 29 form a second passage that allows communication between the first passages 1*c* and the suction chamber 8 when the rotary valve 26 rotates by a predetermined angle.

When the outer peripheral surface of the rotary valve 26 faces one of the first passage 1*c* according to the rotation of the valve 26, the communication between the working chamber 30 and the suction chamber 8 is cut off. Further, when the suction guiding groove 29 faces one of the first passage 1*c*, the associated working chamber 30 is allowed to communicate with the suction chamber 8.

On the other hand, as shown in FIG. 1, a discharge chamber 9 is disposed around the suction chamber 8 in the rear housing 4. The discharge chamber 9 opens through the rear end surface of the rear housing 4. A plurality of discharge ports 5*a* that communicate the associated working chambers 30 with the discharge chamber 9 are bored through the valve plate 5. A plurality of discharge valves 6*a* that open or close the associated discharge ports 5*a* are so formed as to correspond to the discharge ports of the discharge plate 6. As the refrigerant gas in each working chamber 30 is compressed in response to the movement of each piston 25, the compressed gas causes the discharge valve 6*a* to be opened. Simultaneously, highly pressurized refrigerant gas in the working chamber 30 is guided to the outside of the casing through the discharge port 5*a* and the discharge chamber 9. A retainer 7*a* is so formed in a retainer plate 7 as to regulate the opening position of the discharge valve 6*a*.

A crank chamber 3 is so formed in the front housing 2 as to communicate with each cylinder bore 1*a*. A mechanism that converts the rotation of the drive shaft 10 into the reciprocal motion, and transmits the converted motion to the pistons 21, is disposed in the crank chamber 3. The mechanism will now be described in detail. A lug plate 13 is disposed in the crank chamber 3 so as to be in rotatable communication with drive shaft 10. A thrust bearing 14 is interposed between the lug plate 13 and the front housing 2. Therefore, the lug plate 13 smoothly integrally rotates with the drive shaft 10 while slidably contacting with the thrust bearing 14.

A cylindrically shaped slider bushing 18 is mounted on the drive shaft 10 and is reciprocally movable in a front and rear axial direction. A rotary journal 16 is loosely mounted on the drive shaft 10. A boss section 16*a* of the journal 16 is jointed with the slider bushing 18 by a coupling pin 19. Furthermore, the journal 16 is jointed with the lug plate 13. Specifically, an arm section 13*a* having an elongated hole 13*b* is formed at the outer peripheral section of the lug plate 13 and protrudes rearward. A coupling pin 15 is so secured at the outer peripheral portion of the rotary journal 16 as to correspond to the arm section 13*a*, and is fitted into the elongated hole 13*b*.

Therefore, the journal 16 integrally rotates with the drive shaft 10 and the lug plate 13. The journal 16 is rotatable about the coupling pin 19. When the journal 16 rotates about the coupling pin 19, the coupling pin 15 slides along the elongated hole 13*b*, and further the slider bushing 18 moves along the drive shaft 10. An inclination degree of the journal 16 is representative of the angle between the journal 16 and a surface perpendicular to the drive shaft 10.

A spring retainer 23 is mounted on the drive shaft 10. A coil spring 24 is so disposed between the spring retainer 23 and the slider bushing 18 as to be compressed therebetween. The coil spring 24 generally urges the slider bushing 18 such that the inclination angle of the swash plate 17 may be increased. The increase of the inclination angle enlarges the magnitude of the stroke of the pistons 21, so that the amount of the refrigerant gas discharged from the working chambers 30 is increased.

The swash plate 17 is provided on the boss section 16*a* of the rotary journal 16. A pin 17*a* is movably fitted to the swash plate 17. An anti-rotation member 20 is secured to the cylinder block 1 and the front housing 2, with which the pin 17*a* engages. The engagement of the pin and the anti-rotation member prevents the rotation of the swash plate 17, but allows the swing motion in a back-and-forth direction.

Each piston 21 is coupled to the swash plate 17 by means of piston rod 22. Accordingly, when the drive shaft 10 is rotated, the rotation is transmitted to the swash plate 17 via the lug plate 13, the coupling pin 15 and the rotary journal 16. The swash plate 17 is swung in the back-and-forth direction while its rotation is prevented. This swinging motion is then transmitted to the pistons 21 via the associate piston rods 21, respectively. In this manner, the rotation of the drive shaft 10 is converted into the liner reciprocal motion of the pistons 21. As a result, the pistons 21 are sequentially reciprocated in the associated cylinder bores 1*a* with different timings, respectively.

It is preferable that a gap between the outer peripheral surface of the rotary valve 26 and the valve chamber 25 is minimized in order to prevent the highly pressurized refrigerant gas compressed by the pistons 21 in the working chambers 30 from leaking into the valve chamber 25. On the other hand, in order to achieve the smooth rotation of the rotary valve 26 in the valve holding chamber 25, it is important for the gap to be set with a rather large size.

To solve the above-described contradictory requirements, this embodiment has the following structure. A preferable gap between the valve holding chamber 25 and the rotary valve 26 is provided in order to achieve the smooth rotation of the rotary valve 26. As shown FIGS. 1 through 4, an endless gas bypass groove 31 including a low pressure groove 31*a*, a high pressure groove 31*b* and a pair of communication passages 31*c*, 31*d* are formed in outer peripheral surface of the rotary valve 26. The low and high pressure grooves 31*a*, 1*b* extend along the axis line in parallel. The low pressure groove 31*a* is so formed as to correspond to the first passage 1*c* of the cylinder bore 1*a* at the lower pressure side, when the high pressure groove 31*b* corresponds to the first passage 1*c* of the cylinder bore 1*a* at the time of completing the discharge stroke. The communication passages 31*c*, 31*d* extend along the circumference of the rotary valve 26 while the first passage 1*c* is disposed therebetween, and communicate with the high and low pressure grooves 31*b*, 31*a*.

According to this structure, after the highly pressurized refrigerant gas in the working chambers 30 is introduced into the gap between the valve chamber 25 and the rotary valve 26 through the first passage 1*c*, almost all the gas is collected in the groove 31. Therefore, the leakage of the gas from the working chambers 30 to the valve chamber 25 is prevented.

When the discharge of the refrigerant gas from a specific cylinder bore 1*a* is completed, the high pressure groove 31*b* faces to the first passage 1*c* of the specific cylinder bore 1*a*. Therefore, the remaining gas in the working chamber 30 is led into the high pressure groove 31*b* through the first passage 1*c* in a state where the piston is positioned at the top dead center. Simultaneously, the other cylinder bore 1*a* starts the compression stroke after the suction of the refrigerant gas is completed, such that the low pressure groove 31*a* faces to the first passage 1*c* of the other cylinder bore 1*a*. Therefore, the remaining gas led into the high pressure groove 31*b* flows into the lower pressure groove 31*a* through the communicating passages 31*c*, 31*d*, and then is bypassed to the cylinder bore 1*a* in the compression stroke through the first passage 1*c*. As a result, according to this embodiment, re-expansion of the remaining gas hardly occurs while the cylinder bore 1*a* is in the suction stroke. The refrigerant gas in the suction chamber 8 is securely sucked into the associate cylinder bores 1*a*.

According to the compressor of this type, the discharge displacement thereof can be continuously regulated by changing the inclination angle of the swash plate 17. The smaller the inclination angle becomes, the smaller the amount of stroke becomes which thereby reduces the discharge displacement. The inclination angle of the swash plate 17 is determined by the differential pressure $\Delta P$ between the suction pressure Ps applied on the piston 21 at the working chamber 30 side and the crank chamber pressure Pc applied on the piston at the crank chamber 3 side.

As the differential $\Delta P$ increases, the swash plate 17 moves around the coupling pin 15 to reduce the inclination angle. If the differential $\Delta P$ is changed according to the load required for cooling, it is possible to discharge the amount of refrigerant gas which is preferable for the load required for cooling. According to this embodiment, as the suction pressure Ps is proportionally changed according to the cooling load, by way of adjusting the pressure in the crank chamber Pc, the preferable amount of the highly pressurized refrigerant gas can be discharged in response to the cooling load. A mechanism for controlling the pressure in the crank chamber Pc will now be described.

As shown in FIG. 1, a gas supply passage 33 is provided for guiding the gas compressed by the pistons 21 to the crank chamber 3. The gas supply passage 33 includes the first passages 1*c*, the communication passage 26*b* of the rotary valve 26, the bottom surface of the recess 1*b*, a ring shaped space S and a second passage "g".

As described above, the first passages 1*c* open to the cylinder bores 1*a*. The first passage 1*c* has two functions. The first function is to communicate the suction chamber 8 with the corresponding working chamber 30. The second function is to communicate the crank chamber 3 with the corresponding working chamber 30. One end of the communication passage 26*b* opens to the outer peripheral surface of the rotary valve 26. The other end opens to the front surface of the rotary valve 26. The opening in the outer peripheral surface of the communication passage 26*b* faces the first passage 1*c* when the associated piston 21 is in the middle of the compression stroke. The communication passage 26*b* has a smaller diameter than that of the first passage 1*c* so that it can act as a throttle. The second passage comprises a clearance "g" within the radial bearing 12 that supports the drive shaft 10 in the cylinder block 1.

The rotary valve 26 has two functions. The first function is to allow and cut off the communication between the suction chamber 8 and the first passages 1*c*. The second function is to allow and cut off the communication between the space S and the first passages 1*c*. The radial bearing 12 has two functions. The first function is to rotatably support the drive shaft 10. The second function is to communicate the space S with the crank chamber 3.

When the rotary valve 26 rotates to a position where the opening of the communication passage 26*b* at the outer peripheral surface side faces to the associated first passage 1*c*, the working chamber 30 is communicated with the crank chamber 3 through the gas supply passage 33. At this time, the associated piston 21 is in the middle of the compression stroke. Therefore, a part of the refrigerant gas having intermediate pressure between the pressures where the piston 21 is at the bottom dead center and the top dead center, is introduced into the crank chamber 3 through the gas supply passage 33. When the communication passage 26*b* does not face to the first passage 1*c*, the communication between the working chamber 30 and the crank chamber 3 is cut off by the outer peripheral surface of the rotary valve 26.

Figure 7:
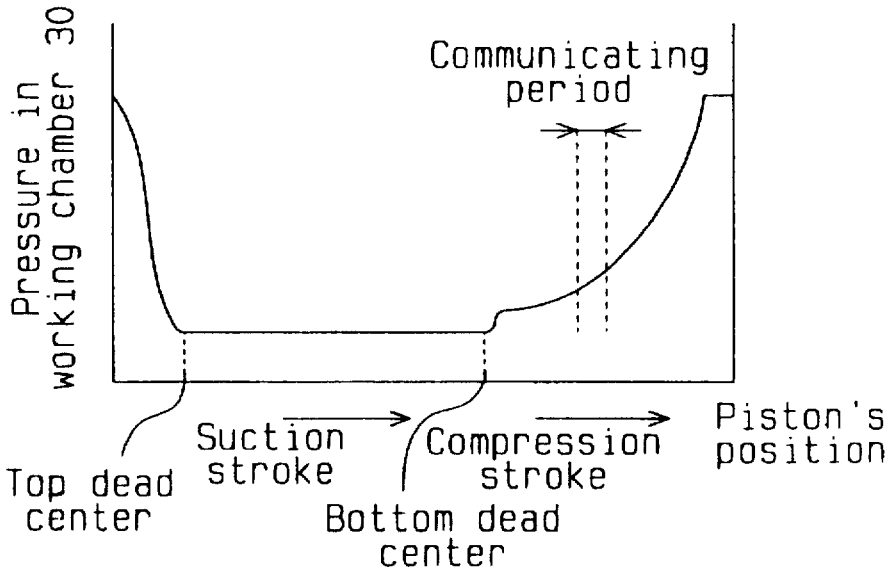

The change in pressure of the working chambers 30, based upon the opening or closing of the gas supply passage 33, will now be described with reference to FIG. 7. When the piston 21 moves from the top dead center to the bottom dead center, i.e., in the suction stroke, the pressure in the working chambers 30 is maintained to be constant. When the piston 21 is shifted into the compression stroke after completing the suction stroke, the pressure in the working chambers 30 gradually increases. The gas supply passage 33 is opened during a predetermined period at the initial stage of the compression stroke, so that the working chambers 30 and the crank chamber 3 are communicated with each other. The refrigerant gas, (having an intermediate pressure Pn between the suction pressure Ps and the discharge pressure Pd) is supplied from the working chambers 30 to the crank chamber 3.

Figure 5:
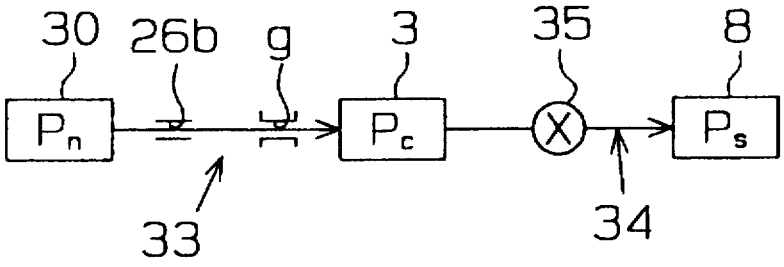

As shown in FIGS. 1 and 5, a bleed passage 34 that communicates the crank chamber 3 with the suction chamber 8 is disposed in the cylinder block 1, the valve plate 5 and the rear housing 4. The bleed passage 34 includes an opening 34*a* disposed at the crank chamber 3 side and an opening 34*b* disposed at the suction chamber 8 side. A pressure regulating valve 35 for adjusting the pressure in the crank chamber 3 is interposed in the bleed passage 34 in order to open or close the passage 34.

Figure 6:
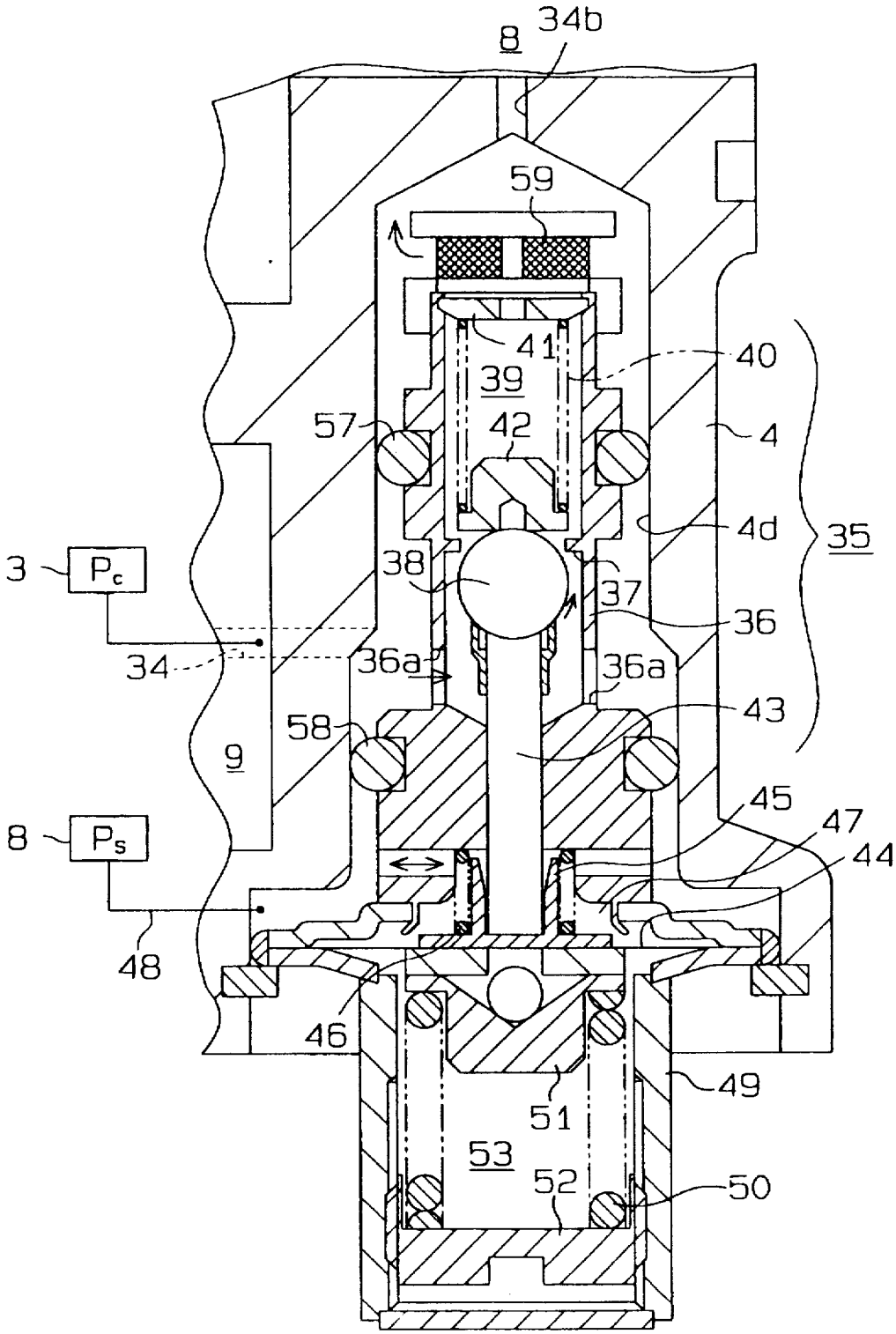

As shown in FIG. 6, the pressure control valve 35 is accommodated in an inner space 4*d* of the rear housing 4 and includes a valve casing 36 and a cylindrical casing 49 disposed under the valve casing 36. A pair of seals 57, 58 are disposed between the valve casing 36 and the space 4*d*, and are spaced apart from each other a predetermined distance in the vertical direction. The space 4*d* is divided into three sections by these seals 57, 58. An opening 36*a* is formed in the internal wall of the valve casing 36 that communicates the outside of the valve casing 36 with the inside between the top and bottom seals 57, 58. A valve chamber 39 that is a part of the bleed passage 34 is disposed in the valve casing 36. A valve seat 37 is disposed in the middle of the valve chamber 39. A spherically shaped valve 38 is disposed in the valve seat 37, which contacts with or is released from the bleed passage 34 to close or open the passage 34. A pair of spring retainers 41, 42 are disposed in the valve chamber 39. A spring 40 is disposed between the spring retainers 41, 42, and is compressed therebetween. The spring 40 continuously urges the valve 38 along the direction in which the valve seat 37 is to be opened (i.e., downward in FIGS. 1 and 6).

Referring again now to FIG. 6, diaphragm 44 is provided between the valve casing 36 and the cylindrical casing 49 to lift the spherically shaped valve 38 so as to close the valve seat 37. A pressure sensitive chamber 47 is disposed at the upper side of the diaphragm 44. A constant pressure chamber 53 is disposed at the bottom side of the diaphragm 44. The pressure sensitive chamber 47 communicates with the suction chamber 8 through a communication passage 48. The refrigerant gas in the suction chamber 8 acts on the top surface of the diaphragm 44 via the passage 48 and suction chamber 8. A compressed spring 46 is disposed in the chamber 47 to usually urge a spring retainer 45 on the diaphragm 44 downward. The constant pressure chamber 53 is hermetically sealed such that the internal pressure therein is kept constant. A spring 50 is disposed underneath of the diaphragm 44 in the constant pressure chamber 53, which is compressed and continuously urges a spring retainer 51 upward. The diaphragm 44 bends to either the upper or the lower side depending on the pressures which are applied to the upper and lower side if the diaphragm. A working rod 43 is disposed between the spring retainer 45 and the valve 38. The change in position of the diaphragm 44 is transmitted to the valve 38 via the working rod 43.

Operation of the preferred embodiment having the above-described structure will now be described.

When the refrigerant gas in the working chamber 30 is to be compressed by means of the associated piston 21, a part of the compressed refrigerant gas flows into the crank chamber 3 directly as a blow-by gas through the clearance between the piston 21 and the cylinder bore 1*a*. At the earlier stage of the compression stroke, the communication passage 26*b* faces to the first passage 1*c* in response to the rotation of the rotary valve 26, so that the associated working chamber 30 and the crank chamber 30 are intercommunicated via the gas supply passage 33 for a predetermined period of time. The refrigerant gas having the intermediate pressure Pn in the working chamber 30 flows into the crank chamber 3 through the gas supply passage 33 according to this communication. As the blow-by gas and the refrigerant gas having the intermediate pressure Pn flow into the crank chamber 3, the internal pressure therein increases. The refrigerant gas in the crank chamber 3 is guided into the suction chamber 8 side through the bleed passage 34. However, the pressure in the crank chamber 3 is adjusted by the pressure control valve 35 that is disposed in the middle of the bleed passage 34 in the following manner.

When the pressure in the suction chamber 8 (suction pressure Ps) is dropped due to the reduction of the load for cooling, the pressure in the pressure sensitive chamber 47 drops, so that the diaphragm 44 bends upward in the pressure control valve 35. As the diaphragm 44 bends upward, the working rod 43 moves upward, so that the valve 38 is lifted to contact with the valve seat 37 so as to close the bleed passage 34. Consequently, the refrigerant gas in the crank chamber 3 is not led into the suction chamber 8 allowing the pressure Pc in the crank chamber 3 to remain high.

Contrarily, when the suction pressure Ps increases due to the increase of the load for cooling, the pressure in the pressure sensitive chamber 47 increases, so that the diaphragm 44 bends downward in the pressure control valve 35. Consequently, the working rod 43 moves downward, such that the valve 38 is urged downward so as to communicate the inside of the valve casing 36 with an opening 34*a* at the crank chamber side of the bleed passage 34 through a hole 36*a* of the casing 36. As a result, the refrigerant gas in the crank chamber 3 is led into the suction chamber 8 through the opening 34*a* of the bleed passage 34, the hole 36*b*, the valve casing 36, a strainer 59 and the opening 34*a* causing the pressure Pc in the crank chamber 3 to drop. The pressure in the crank chamber 3 is adjusted according to the fluctuation of the suction pressure Ps.

As the suction pressure Ps drops due to the reduction of the load required for cooling, the pressure in crank chamber Pc applied on the pistons 21 from the crank chamber 3 increases. The differential ΔP between the pressure Pc in the crank chamber 3 and the suction pressure Ps increases. As a result, the stroke of each piston 21 decreases, and the inclination angle of the swash plate 17 decreases, such that the discharge displacement is also decreased.

Contrarily, when the suction pressure Ps increases due to the increase of the load for cooling, the pressure Pc acting on the piston 21 from the crank chamber 3 side decreases, so that the differential pressure ΔP decreases. As a result, the stroke of each piston 21 increases so as to increase the inclination angle of the swash plate 17, such that the discharge displacement is increased.

An electromagnetic control valve (not shown) that may be opened or closed by an external drive power, can be employed in place of the pressure regulating valve 35.

Incidentally, as described in this embodiment, the gas supply passage 33 is provided for communicating the cylinder bores 1*a* with the crank chamber 3. The rotary valve 26 is provided for opening the gas supply passage 33 while the associated piston 21 is in the compression stroke. An intermediate pressure Pn between the pressure at the compression stroke initiation time (i.e., the lowest pressure) and the pressure at the compression completion time (i.e., the highest pressure) is supplied into the crank chamber 3 during a predetermined period of time in the compression stroke. Therefore, according to this embodiment, the loss of power consumed by controlling the displacement can be reduced, in comparison to the conventional compressor, in which the high pressurized refrigerant gas is supplied from the discharge chamber to the crank chamber.

Figure 8:
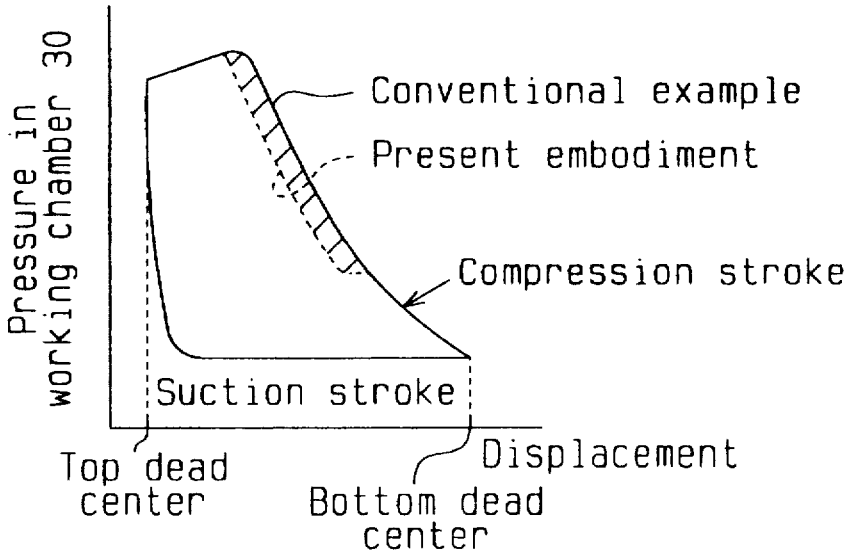

On the other hand, as shown in FIG. 8, the pressure change in the working chamber 30 according to the conventional embodiment is indicated by a solid line. The pressure change in the working chamber 30 according to this embodiment is indicated by a broken line. As described in this embodiment, the refrigerant gas having the intermediate pressure Pn is temporarily supplied from the gas supply passage 33 to the crank chamber 3, in the middle of the compression stroke while the associated piston 21 moves from the bottom dead center to the top dead center. The pressure in the working chamber 30 is dropped by the amount equal to the supplied gas in the middle of the compression stroke. Therefore, the power output of the compression stroke is reduced by the amount equal to the hatched area in FIG. 8, in comparison to the conventional embodiment. Therefore, the maximum discharge displacement pressure of the refrigerant gas may be slightly dropped, however, it is within the allowable range, in comparison to the conventional embodiment.

According to this embodiment, the first passages 1*c* for introducing the refrigerant gas into the associated working chambers 30 are employed as a part of the gas supply passage 33 for controlling the displacement. Therefore, a special passage connecting the working chambers 30 to the valve chamber 25 is not required to be a specially constructed in the cylinder block 1. Further, according to this embodiment, the clearance "g" defined within the radial bearing 12 is employed as a part of the gas supply passage 33. Therefore, a special passage communicating the recess 1*b* to the crank chamber 3 is not required to be especially constructed in the cylinder block 1.

According to this embodiment, the ring shaped space S defined around the drive shaft 10 between the bottom surface of the recess 1*b* and the rotary valve 26 is employed as a part of the gas supply passage 33. Therefore, a special passage communicating the rotary valve 26 to the clearance "g" is not required to be especially constructed. In order to form the gas supply passage 33, only the communication passage 26*b* is required to be especially constructed in the rotary valve 26. Therefore, the gas supply passage 33 is easily manufactured.

Second Embodiment

The second embodiment according to the present invention will now be described referring to FIGS. 9 through 13.

According to this embodiment, the location where the gas supply passage 33 for controlling the displacement is formed, the position where the pressure regulating valve 35 is arranged, and the location where the bleed passage 34 is formed, are all significantly differ from those described in the first embodiment. Therefore, the structural members employed in this embodiment similar to those described in the first embodiment are given identical references, so as to omit those explanations thereof. The second embodiment description only emphasizes the differences from the first embodiment.

Figure 9:
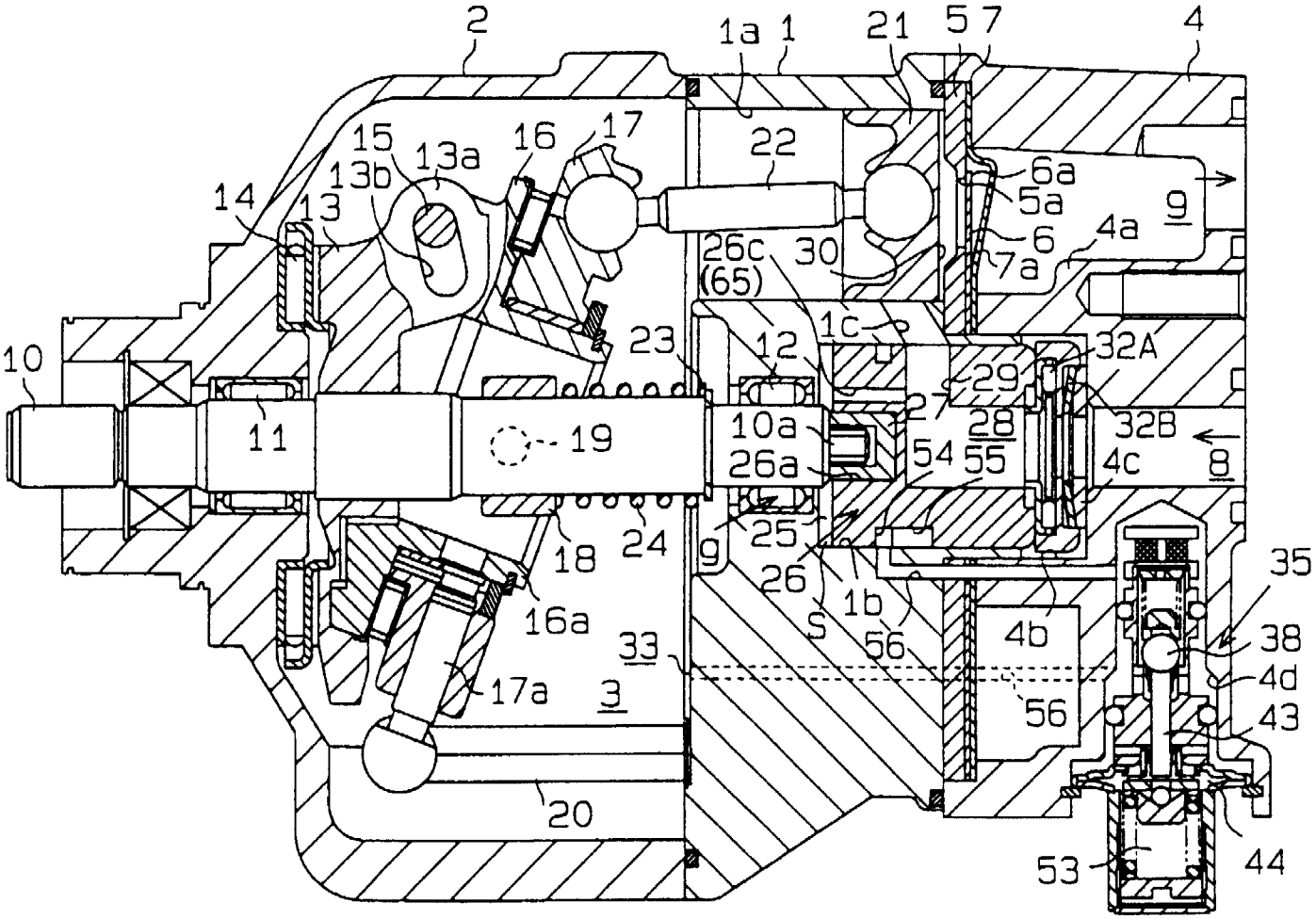
FIGS. 9 through 13 show a second embodiment according to the present invention.
Figure 11:
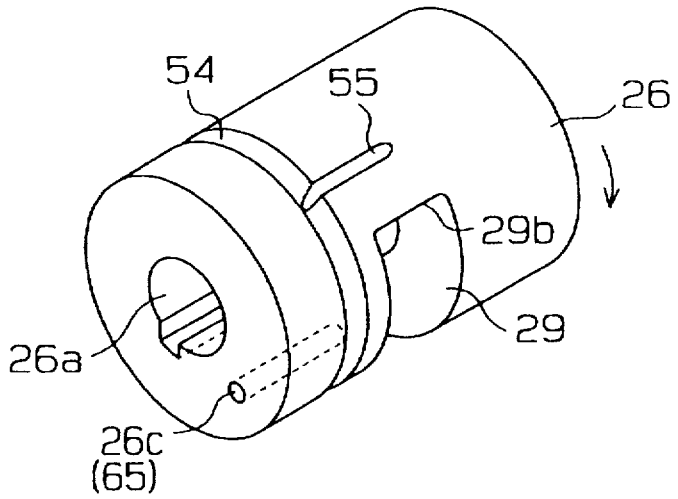
Figure 12:
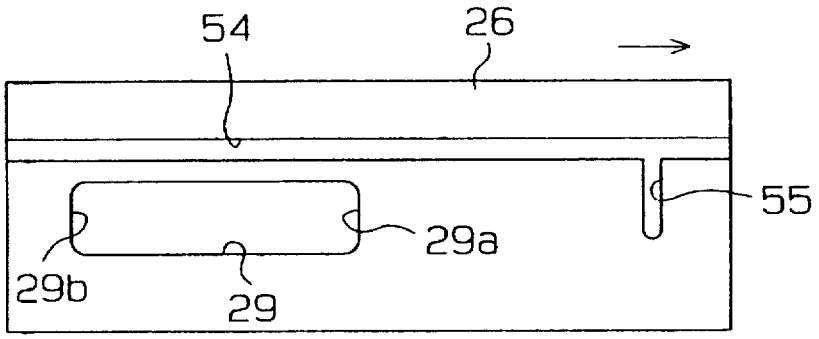
Figure 13:
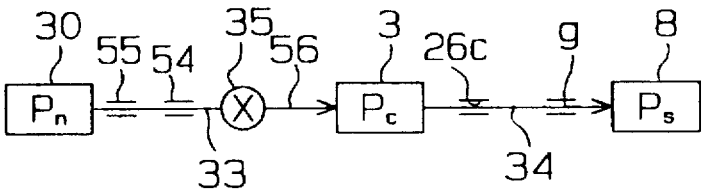

As shown in FIGS. 9 and 11, the gas supply passage 33 is formed with the first passages 1*c*, a ring shaped groove 54, an extended groove 55 and a passage 56. The ring shaped groove 54 extends circumferentially at a location different from that of the suction guiding groove 29 on the outer periphery of the rotary valve 26. The extended groove 55 is so disposed on the outer periphery of the rotary valve 26 as to be in an identical phase to the outer peripheral opening of the communication passage 26*b* in the first embodiment. The extended groove 55 linearly extends rearward from the groove 54 along the axis of the rotary valve 26. The passage 56 is disposed in the cylinder block 1, the valve plate 5 and the rear housing 4. One end of the passage 56 opens to the inner peripheral surface of the recess 1*b* so as to be in communication with the groove 54. The other end of the passage 56 opens to the crank chamber 3.

Figure 10:
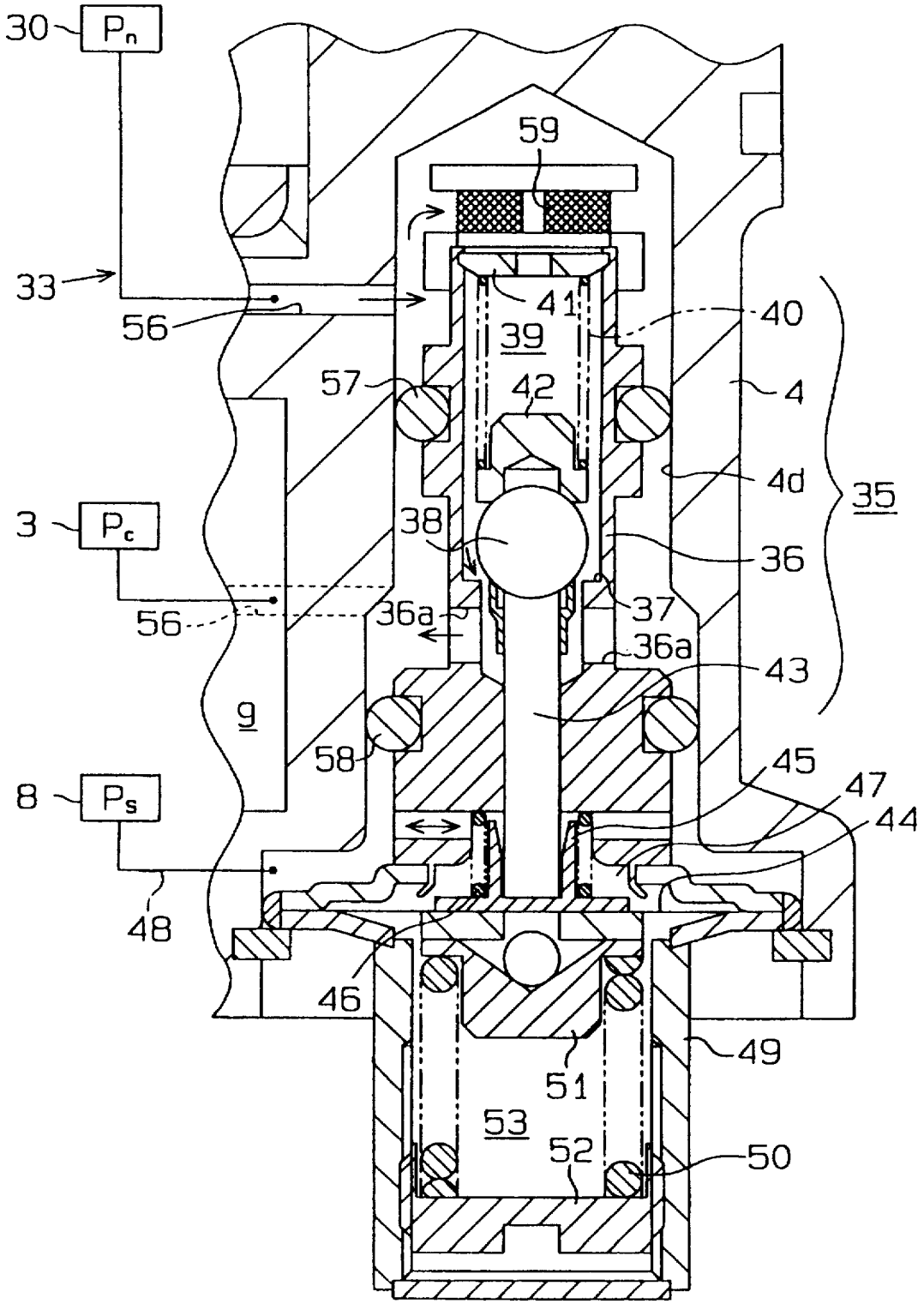

A pressure control valve 35 shown in FIG. 10 is disposed in the middle of the passage 56. The valve 35 is for adjusting the pressure in the crank chamber 3 by opening or closing the gas supply passage 33, accordingly. The valve 35 has a generally identical structure to that in the first embodiment except for the position of the valve seat 37. The pressure sensitive chamber 47 in the pressure control valve 35 communicates with the suction chamber 8 through a communication passage 48. The upper stream side of the valve 38 communicates with the inner peripheral surface of the recess 1*b* via the inside of the valve casing 36, a strainer 59, and the valve side of the passage 56. The downstream side of the valve 38 communicates with the crank chamber 3 via the opening 36*a* of the valve casing 36 and the crank chamber side of the passage 56.

The pressure control valve 35 acts in the following manner, according to the load for cooling. When the load for cooling drops so that the suction pressure Ps in the suction chamber 8 is reduced, the pressure in the pressure sensitive chamber 47 is also reduced. Consequently, the diaphragm 44 bends upward, so that the working rod 43 moves upward. This upward motion of the rod 43 causes the valve 38 to open from the valve seat 37. Then, the valve side and the crank chamber side of the passage 56 are intercommunicated.

Contrarily, when the load for cooling increases so that the suction pressure Ps is increased, the pressure in the chamber 47 is also increased. Consequently, the diaphragm 44 bends downward, so that the working rod 43 moves downward. This downward motion of the rod 43 causes the valve 38 to contact with the valve seat 37 so as to close the passage 56.

The bleed passage 34 is formed with the clearance "g" defined in the radial bearing 12, the ring shaped space S around the drive shaft 10 disposed between the bottom surface of the recess 1*b* and the rotary valve 26, and the communication passage 26*c*. The clearance "g", the space S, and the suction passage 28 are identical to those described in the first embodiment. The communication passage 26*c* extends in parallel to the axis of the rotary valve 26. The front end of the passage 26*c* opens to the space S, and the rear end thereof opens to the suction guiding groove 29. The passage 26*c* has a small diameter so that it can act as a throttle. No pressure control valve 35 is provided in the bleed passage 34.

According to the compressor having the above-described structure of this second embodiment, when the piston is in the compression stroke, the blow-by gas flows directly into the crank chamber 3 through the clearance between each piston 21 and the associated cylinder bore 1*a*.

At the initial stage of the compression stroke, the groove 55 faces to the first passage 1*c* in response to the rotation of the rotary valve 26. Consequently, the refrigerant gas having the intermediate pressure Pn in the working chamber 30 flows into the passage 56 through the first passage 1*c*, the groove 55 and the ring shaped groove 54.

At this time, if the load for cooling is small (i.e., suction pressure Ps is low) and the valve 38 in the pressure control valve 35 is away from the valve seat 37, the refrigerant gas having the intermediate pressure Pn in the working chamber 30 flows into the crank chamber 3 through the passage 56. Since the blow-by gas and the refrigerant gas having the intermediate pressure Pn flow into the crank chamber 3, the pressure in the crank chamber 3 increases. The differential ΔP is increased based upon the reduction of the suction pressure Ps applied on the piston 21 from the associate working chamber 30 side and the increase of the pressure Po in the crank chamber acting on the rear surface of the piston 21. As a result, the stroke of the piston 21 is reduced so as to reduce the inclination angle of the swash plate 17. Therefore, the discharge displacement is reduced.

Contrarily, when the load for cooling is large (i.e., suction pressure Ps is high) and the valve 38 in the pressure control valve 35 sits down on the valve seat 37, and the communication between the working chamber 30 side and crank chamber side 3 of the passage 56 is cut off. Accordingly, the refrigerant gas having the intermediate pressure Pn does not flow from the working chamber 30 into the crank chamber 3. Therefore, the pressure in the crank chamber 3 is reduced. As the suction pressure Ps increases and the pressure in the crank chamber 3 decreases, the differential ΔP between both pressures decreases. As a result, the stroke of the piston 21 increases so that the inclination angle of the swash plate 17 increases. Then corresponding discharge displacement increases.

The refrigerant gas in the crank chamber 3 is led into the suction chamber 8 by flowing through the bleed passage 34 (i.e., the clearance "g" of the radial bearing 12, the ring shaped space S, the communication passage 26*c*, and the suction guiding groove 29).

According to this second embodiment, the refrigerant gas having the intermediate pressure Pn between the pressure at the compression initiating period (i.e., the lowest pressure) and the pressure at the compression stroke completing period (i.e., the highest pressure) is led into the crank chamber 3 during the compression stroke, like the first embodiment. Therefore, the power consumed by controlling the displacement can be reduced, in comparison to the conventional compressor in which the highly pressurized refrigerant gas is supplied from the discharge chamber to the crank chamber.

Although only two embodiments of the present invention have been described herein, it should be apparent to those skilled in the art that the present invention may be embodied in many other specific forms without departing from the spirit or scope of the invention. Particularly, it should be understood that the following modes can be applied.

Figure 14:
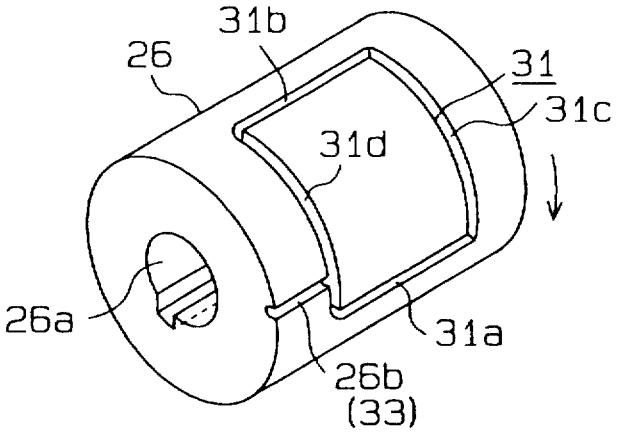
FIG. 14 is a perspective view of a rotary valve in another embodiment according to the present invention.

(1) The communication passage 26*b* in the first embodiment can be provided in the outer periphery of the rotary valve 26. For example, as shown in FIG. 14, the communication passage 26*b* can be formed with a straight groove of which the front end is connected to the front surface of the rotary valve 26 and the rear end is connected to the communication passage 31*d* of the gas bypass groove 31 and the inner peripheral surface of the valve chamber 25. If the passage 26*b* is formed as described above, when the discharge displacement is large, the gas bypass groove 31 can collect the remaining gas from the working chambers 30. On the other hand, when the discharge displacement is small, the refrigerant gas having the intermediate pressure Pn in the middle of the compression stroke can be led into the crank chamber 3 through the bypass groove 31 and communication passage 26*b*.

Figure 15:
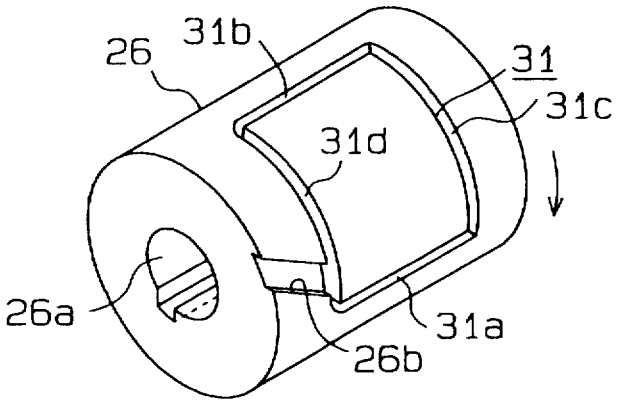
FIG. 15 is a perspective view of a rotary valve in yet another embodiment according to the present invention.

Further, the communication passage 26*b* can be so formed as to cross the axis of the rotary valve, as shown in FIG. 15, line. In this case, the width of the passage 26*b* is set wider than that of passage 26 shown in FIG. 14, so that the clogging in the communication passages 31*c*, 31*d* can be prevented.

Figure 16:
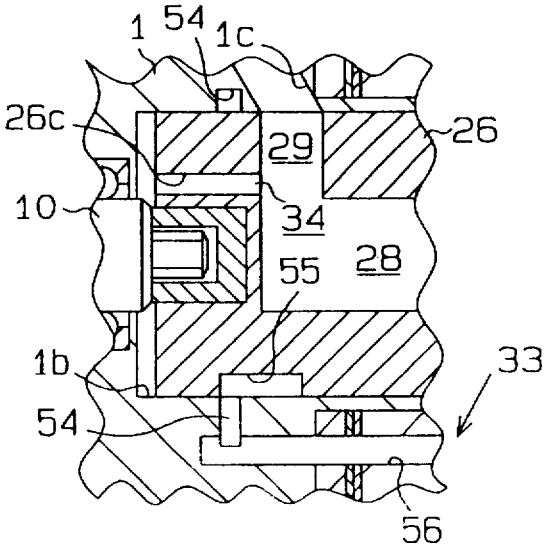
FIG. 16 is a partial cross-sectional view showing the rotary valve in a further embodiment.

(2) The ring shape groove 54 formed in the outer periphery of the rotary valve 26 according to the second embodiment can be formed in the inner peripheral surface of the recess 1*b* of the cylinder block 1 as shown in FIG. 16. Furthermore, the ring shape grooves 54 can be formed in the outer periphery of the rotary valve 26 and the inner peripheral surface of the recess 1*b*.

(3) The pressure control valve 35 was provided only in the middle of the bleed passage 34 in the first embodiment. However, the valve 35 (including an electromagnetic valve) can be provided in the middle of the gas bleed passage 34. The pressure control valve 35 was provided only for the gas supply passage 33. However, the valve 35 (including an electromagnetic valve) can be provided in the middle of the bleed passage 34.

(4) The valve chamber 25 can be formed only at the cylinder block 1 side or only at the rear housing 4 side rather than partially in both as in the preferred embodiment.

Therefore, the present examples and embodiments are to be considered as illustrative and not restrictive and the invention is not to be limited to the details given herein, but may be modified within the scope of the appended claims.

What is claimed is:

1. A swash plate type variable displacement compressor comprising:

a casing containing a plurality of cylinder bores;

a separate piston disposed in each of said cylinder bores for reciprocation therein, each of said pistons varying the volume of a separate working chamber in front of the piston head in the cylinder bore that contains the piston, said volume varying in accordance with the reciprocation of the respective piston;

a suction chamber and a discharge chamber provided in said casing;

suction valve means for admitting a low pressure gas into each of said working chambers by enabling communication between each of said working chambers and said suction chamber during a suction stroke when movement of the associated one of said pistons increases the volume of the associated working chamber;

discharge valve means for allowing high pressure gas in each of said working chambers to pass into said discharge chamber by establishing communication between each of said working chambers and said discharge chamber during a compression stroke when movement of the associated one of said pistons decreases the volume of the associated working chamber;

a crank chamber communicating with each of said cylinder bores to the rear of said pistons;

a drive shaft rotatably provided in said crank chamber;

a swash plate tiltably supported on said drive shaft and connected to each of said pistons through associated rods, said swash plate making said pistons reciprocate in response to its undulating swing motion and varying its inclination angle based upon the pressure differential between pressure in said suction chamber and pressure in said crank chamber, whereby the stroke of each of said pistons varies for adjusting discharge displacement in relation to said pressure in said suction chamber;

a gas supply passage for connecting each of said cylinder bores with said crank chamber in order to supply gas to said crank chamber from said cylinder bores during said compression stroke;

a gas bleed passage for connecting said crank chamber to said suction chamber in order to pass gas from said crank chamber to said suction chamber;

a pressure control valve provided in at least one of said gas passages for controlling the pressure of gas in said crank chamber by opening and closing said at least one of said gas passages; and a gas control valve for opening and closing said gas supply passage in the middle of said compression stroke of each of said pistons.

2. A swash plate type variable displacement compressor according to claim 1, wherein said pressure control valve is provided in the middle of said gas bleed passage and said pressure control valve opens and closes said gas bleed passage so that pressure in said crank chamber is maintained constant regardless of variation of pressure in said suction chamber.

3. A swash plate type variable displacement compressor according to claim 1, wherein said gas control valve is provided in the middle of said gas supply passage and said pressure control valve opens and closes said gas supply passage so that pressure in said crank chamber varies depending on variation of pressure in said suction chamber.

4. A swash plate type variable displacement compressor according to claim 1, wherein said gas supply passage comprises a valve chamber for housing said gas control valve, a first guide passage for connecting said valve chamber to said cylinder bores, and a second guide passage for connecting said valve chamber to said crank chamber.

5. A swash plate type variable displacement compressor according to claim 4, wherein said second guide passage includes a gap of a bearing which rotatably supports said drive shaft in said casing said crank chamber passage opens to said valve chamber and said crank chamber.

6. A swash plate type variable displacement compressor according to claim 4, wherein said gas control valve is a rotary valve which rotates synchronously with said drive shaft while having a sliding contact with an inner circumference of said valve chamber, said rotary valve having an outer periphery which cuts off communication between said first and second guide passages and a first communication passage which establishes communication between said first and second guide passages.

7. A swash plate type variable displacement compressor according to claim 6, wherein said first communication passage is provided within said rotary valve and has a first end positioned at the crank chamber side and a second end positioned at the cylinder bore side, said first end normally opens to said second guide passage and said second end opens with said outer periphery of said rotary valve such that said first communication passage communicates to said first guide passage in response to rotation of said rotary valve.

8. A swash plate type variable displacement compressor according to claim 6, wherein said first guide passage is provided between an inner periphery of said valve chamber and said outer periphery of said rotary valve.

9. A swash plate type variable displacement compressor according to claim 6, wherein said first communication passage includes:

a ring shape groove formed on at least one of said outer periphery of said rotary valve and said inner periphery of said valve chamber, said ring shape groove being away from said first guide passage and normally communicating with said second guide passage; and an extended groove formed on said outer periphery of said rotary valve so as to cross said ring shape groove and for communicating with said first guide groove in response to rotation of said rotary valve.

10. A swash plate type variable displacement compressor according to claim 6, wherein said first communication passage is provided on said outer periphery of said rotary valve and has a first end positioned at the crank chamber side and a second end positioned at the cylinder bore side, said first end normally opens to said second guide passage and said second end communicates with said first guide passage in response to rotation of said rotary valve.

11. A swash plate variable displacement compressor according to claim 6 further comprising an endless bypass passage provided on said outer periphery of said rotary valve, said bypass passage simultaneously establishing communications between said first guide passage for one of said cylinder bores in which the discharge of said gas is completed, and said first guide passage for another one of said cylinder bores in which the compression of gas is initiated.

12. A swash plate type variable displacement compressor according to claim 6, wherein said suction chamber is connected to said cylinder bores via said valve chamber and first guide passage, and wherein said rotary valve has an outer periphery which cuts off communication between said first and second guide passages and has a second communication passage which allows communication between said first guide passage and said suction chamber.

* * * * *

UNITED STATES PATENT AND TRADEMARK OFFICE

CERTIFICATE OF CORRECTION

PATENT NO. : 5,486,098

DATED : January 23, 1996

INVENTOR(S) : K. Kimura et al

It is certified that error appears in the above-indentified patent and that said Letters Patent is hereby corrected as shown below:

Column 6, line 5, after "shown" insert --in--; line 8, after "in" insert --the--.

Column 9, line 26, "36b" should read --36a,--"; line 27, "34a" should read --34b--.

Column 14, line 29, after "casing" insert period --.--, delete "said crank chamber passage opens to said valve chamber and said crank chamber."; line 47 after "opens" change "with" to --to--; line 48, after "communicates" change "to" to --with--.

Signed and Sealed this

Twenty-fifth Day of June, 1996

*Attest:*

Bruce Lehman

BRUCE LEHMAN

*Attesting Officer*

*Commissioner of Patents and Trademarks*